US005496025A

United States Patent [19]

Phillips et al.

[11] Patent Number: 5,496,025

[45] Date of Patent: Mar. 5, 1996

[54] PNEUMATIC BALL PITCHING MACHINE FOR DIFFERENT SIZED BALLS

[76] Inventors: Wiley Phillips, Rte. 1, Box 270, Bay Springs, Miss. 39422; Woodrow W. Welborn, Rte. 12, Box 400, Laurel, Miss. 39440

[21] Appl. No.: 201,962

[22] Filed: Feb. 25, 1994

[51] Int. Cl.[6] ..... F41B 15/00

[52] U.S. Cl. ..... 273/26 D

[58] Field of Search ..... 273/26 D, 29 A; 124/16, 56, 62

[56] References Cited

U.S. PATENT DOCUMENTS

| | | | |
|---|---|---|---|
| 1,152,447 | 9/1915 | Sproull | 124/62 |
| 1,379,403 | 5/1921 | Green . | |
| 2,182,369 | 12/1939 | Barron | 273/26 D |
| 2,526,018 | 10/1950 | Foster et al. | 124/56 |
| 3,018,769 | 1/1962 | Parsoneault . | |
| 3,288,127 | 11/1966 | Bullock . | |
| 3,640,263 | 2/1972 | Rhodes . | |
| 3,662,729 | 5/1972 | Henderson . | |
| 3,838,676 | 10/1974 | Kahelin . | |
| 3,915,143 | 10/1975 | Waller | 273/26 D |
| 4,021,037 | 5/1977 | Torbet | 124/56 |
| 4,774,928 | 10/1988 | Kholin | 273/26 D |
| 5,257,615 | 11/1993 | Jones | 124/56 |
| 5,339,789 | 8/1994 | Heitz | 124/62 |
| 5,377,656 | 1/1995 | Lewinski | 124/56 |

*Primary Examiner*—Theatrice Brown

*Attorney, Agent, or Firm*—Edwin E. Greigg; Ronald E. Greigg

[57] ABSTRACT

A ball propelling machine for propelling a ball at a desired speed and in a desired direction including an air pressure tank, a control valve, a device for admitting a ball into a chamber for propelling the ball and a housing with a barrel therein through which the ball is propelled. The machine has a frame for securing the machine in place and adjusting bolts related to the frame for adjusting the direction of propelling the ball. The barrel is operative within the housing for closing off the chamber for propelling the ball and has one end that extends beyond the housing for movement of the barrel into a loading position and into a firing position. The ball is propelled by air pressure which is controlled by a control valve and the speed and distance of travel is determined by the air pressure directed through the control valve.

12 Claims, 3 Drawing Sheets

PNEUMATIC BALL PITCHING MACHINE FOR DIFFERENT SIZED BALLS

This invention relates to a ball pitching machine and more particularly to a ball pitching machine which can be easily changed for pitching a different sized ball such as tennis balls, base balls and soft balls of different diameters.

Heretofore several patents have been issued on different types of ball pitching machines. Some such machines are spring loaded for propelling the ball and also pressure types which propel the ball due to a pressure. Many of the prior art pitching machines are very heavy and are not easily moved from place to place. Further the known pressure pitching machines have a large pressure tank which requires the build-up of a lot of air and due to the large pressure tank the recovery time is great so that a relatively long time must be availed for propelling the next ball.

It is therefore an object to provide a ball pitching machine which is easily operated and which is of light weight for easy movement from place to place.

Another object is to provide a ball pitching machine which can be quickly and easily changed from one ball size to another ball size.

Another object is to provide a system that has a small pressure tank which has a quick recovery for firing a ball every five (5) seconds if it is desired to do so.

Still another object to provide a ball propelling machine which is made of pipes, couplings and valves which does not requires any complicated machining of parts.

While still another object is to provide a ball propelling machine in which the barrel can be easily and quickly changed in order to fire different sized balls such as a tennis ball, baseball or different sized soft balls.

Yet another object is to provide a ball propelling machine which has very few moving parts to propel the ball.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
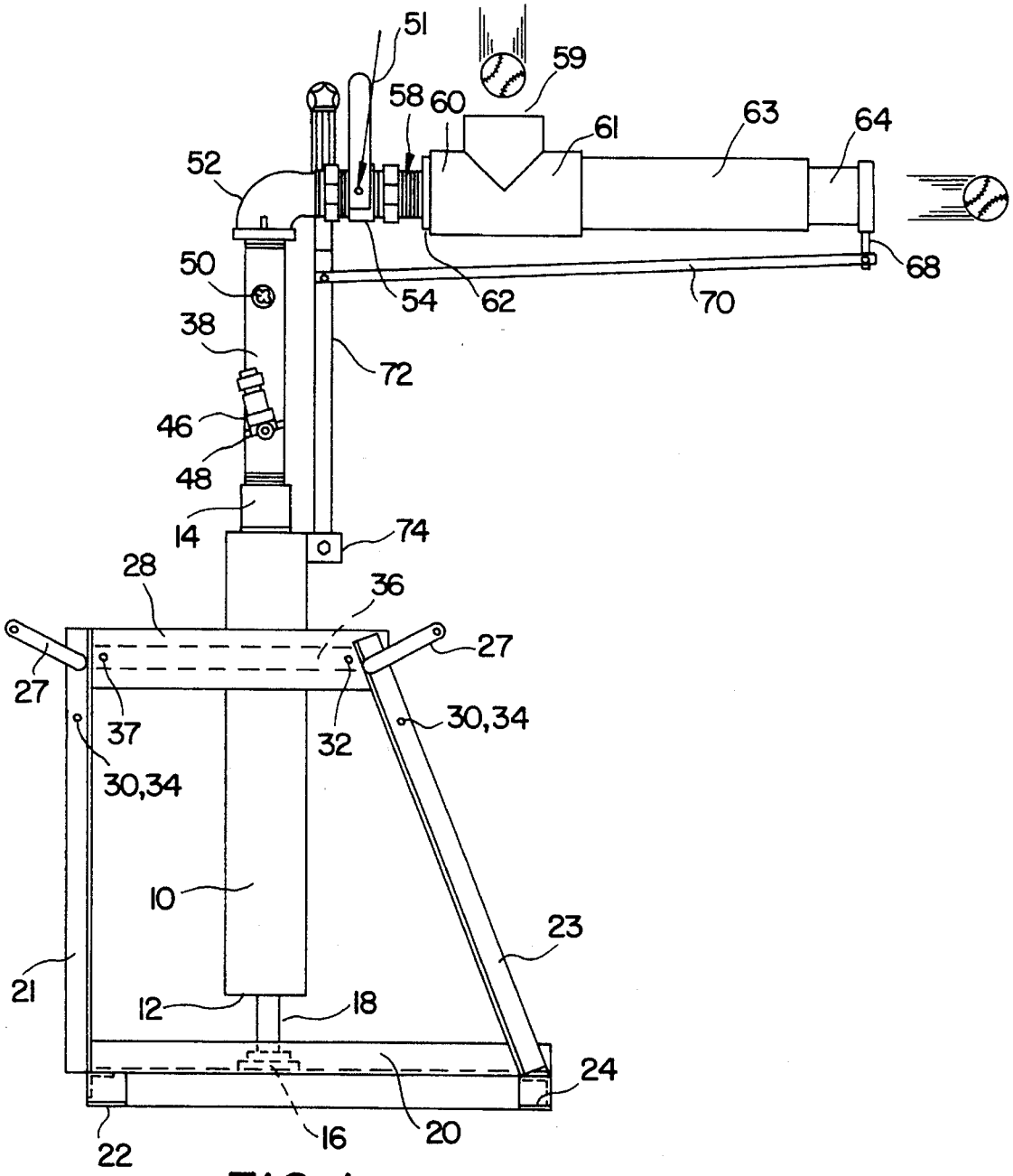
FIG. 1 illustrates a side view of the ball pitching machine.
Figure 2:
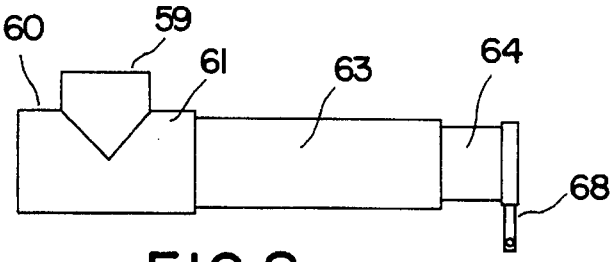
FIG. 2 illustrates a side view of a barrel through which the ball is propelled.
Figure 3:
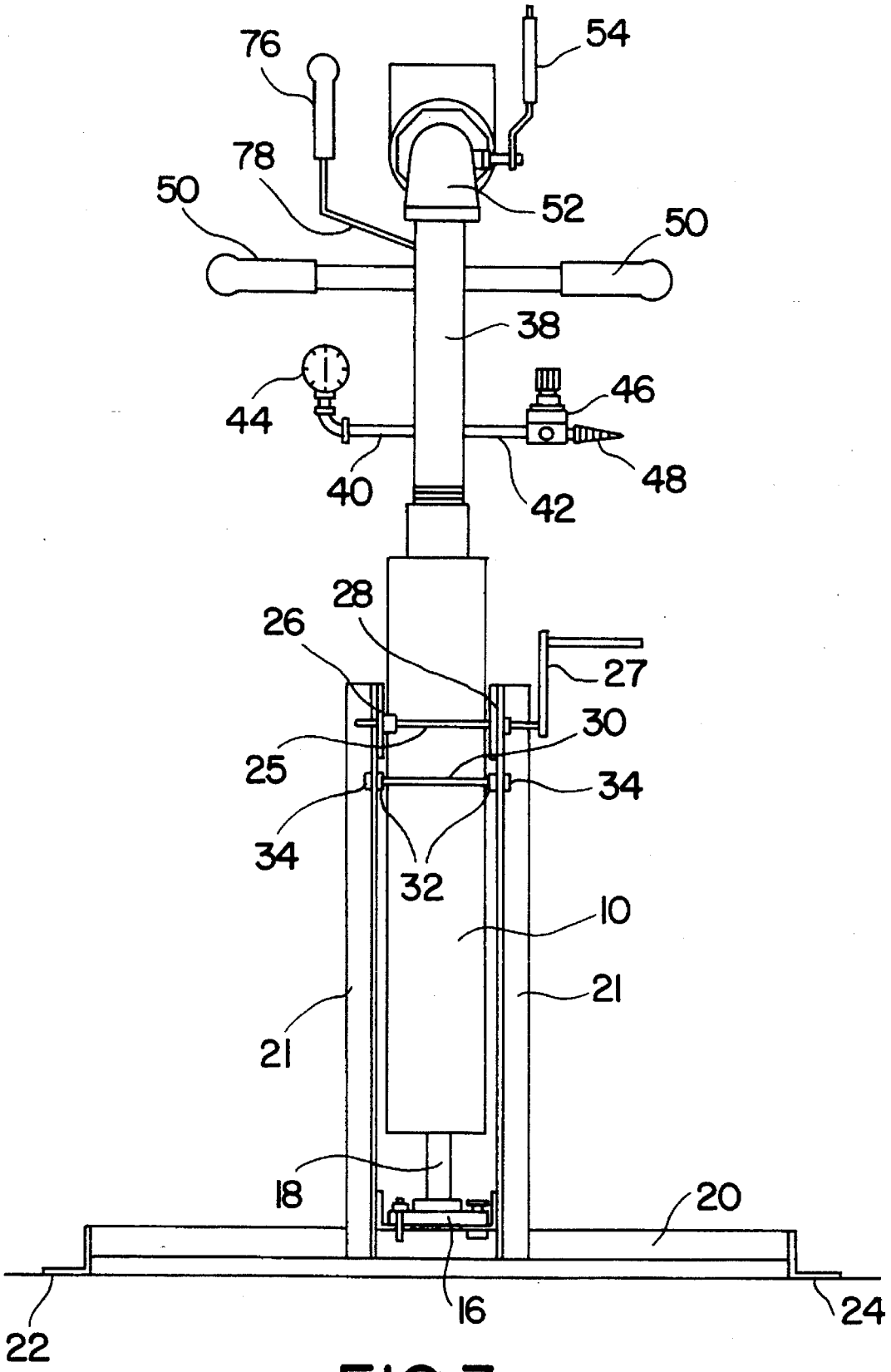
FIG. 3 is a view from the rear of the ball pitching machine.
Figure 4:
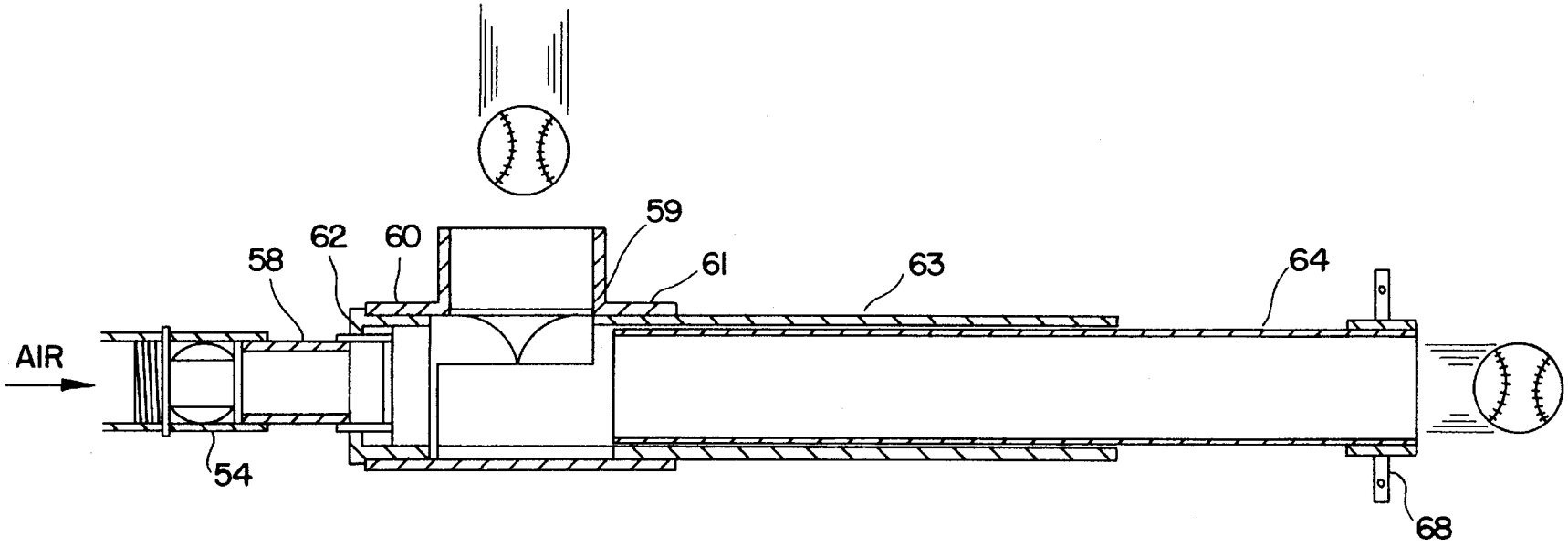
FIG. 4 is a cross-sectional view along the length of the barrel, loader opening and control valve.

Now referring to the drawings, there is shown a ball pitching machine wherein the same reference characters designate the same parts throughout the different views.

The drawings illustrate the various parts of the ball pitching machine including a 4"×25" air pressure tank 10 including a closed end 12 and an open end 14. The closed end is secured to a ⅝ inch swivel bearing 16 via a support rod 18. The swivel bearing 16 is secured to a support formed by angle iron 20 across a middle of spaced angle iron cross pieces 22 and 24 which form the supporting feet. The supporting frame includes four (4) pieces of angle iron 21 that extend upwardly at an angle along opposite sides of the air pressure tank 10 and are connected at their upper ends by adjustable bolts 25 to a pair of flat plates 26, 28 which are on opposite sides of the air pressure tank. The adjustable bolts are easily adjusted by use of a 90° angle handle 27 which is connected to one end of the bolt. Below the adjustable bolts 25 other bolts 30 are provided to assist in holding the support plates together. The lower bolts 30 are provided with a nut 32 on the inside of the angle iron and a nut 34 on the outside of the angle iron. Thus, the inside nut can be adjusted along the threaded bolts for adjusting the spacing of the support angle irons and the outside nuts tighten the angle iron supports against the inside nuts. The plates 26 and 28 are provided with a strip of leather or some other material 36 which faces the air pressure tank and which will tighten against the air pressure tank to hold the ball pitching machine in an adjusted angle. The strip is held in place by bolts 37. By loosening the bolts 25 via the handles 27, the barrel of the ball throwing machine may be adjusted up or down and also right and left and then the bolt can be tightened again to position the barrel in the correct angle for pitching the ball.

A 1½" by 12" pipe 38 is secured to the upper end of the air pressure tank to extend upwardly therefore. The pipe is provided with oppositely directed ¼ inch holes to which a ¼ inch pipe 40, 42 is secured in each hole perpendicular to the pipe 38. To the pipe 40, a pressure gauge 44 is secured and to the pipe 42, a pressure control valve 46 is secured. A pressure line connection 46 for an air pressure pump is secured for connecting an air pressure pump, not shown. Between the ¼ inch pipes and the upper end of the pipe 38, oppositely disposed handles 50 are provided for holding the device while in use. The handles are shown with hand gripper ends.

The upper end of the pipe 38 has a 1½ inch elbow 52 secured thereto and a 1½ inch fluid flow control ball-valve 54 is secured to the elbow 52. The control valve 54 is shown with a handle 56 which is provided to rotate the valve into an open and closed position. The control valve can be provided with stops to prevent moving the handle beyond a fully open position and a fully closed position. A 1½ inch coupling pipe 58 is secured to the fluid flow control valve 54. A plastic (PVC) tee coupling having an end 60 is secured to the 1½ inch coupling 58 by use of a reducer 62 which reduces from a connection with the tee end 60 to a 1½ inch connection with the pipe coupling 58. A PVC pipe 63 having a length of about 13 inches is secured to the opposite end 61 of the PVC tee and the tee is provided with an open end 59. The pipe 63 is connected to the PVC tee to provide a housing within which a metal barrel 64 having a length of about 20 inches is slidable with a close fit. The metal barrel is longer than the pipe 63 and is of such length that when the inner end of the barrel is juxtaposed the end of the reducer connection to the PVC tee the outer end of the barrel extends beyond the end of the PVC pipe 63. The end of the barrel that extends from the housing has a metal band 66 which serves as a stop, to stop the barrel juxtaposed the PVC reducer when fully inside the housing. The band has a downwardly extending bar 68 secured thereto, to which one end of an elongated metal bar 70 is pivotably connected. The opposite end of the metal bar 70 is pivotably connected to a lever 72 which has one end that is pivotably secured to a tab 74 that is welded to the upper end of the air pressure tank. The upper end of the lever 72 has an angularly set end 78 with respect to the lever end secured to the tab 74.

In operation, different sized housings and barrels are provided for different sized balls such as tennis balls, baseballs and different sized soft balls. The metal barrel must be of a diameter which is substantially the diameter of the ball to be projected and the housing must have an inner diameter within which the barrel will slide with a loose fit. The size of the barrel and housing depends upon the size of the ball to be propelled. The size of balls to be used would be, at least as large as the 2½ coupling pipe connected to the control valve. However it would be within the skill of one in the art that a reducer could be connected to the coupling pipe 58 which reduced the barrel and housing down to the size of a ball smaller than 2½. An air compressor is secured to the pressure control valve and a pressure is built-up within the air pressure tank with the control valve 54 in the closed position. When sufficient pressure has been built-up, the lever 72 is moved forward which moves the inner end of the barrel beyond the open entrance 59 of the tee. A ball of the proper size is dropped within the open end of the tee and the lever 72 is moved backwards, as the lever is moved backward, the ball is forced by the inner end of the barrel back to the reducer with a tight fit. Once the pressure is sufficient to propel the ball the desired distance, the control valve 54 is opened and the air pressure will force the ball down the barrel and out of the barrel. In order to prevent using and loosing to much air pressure, the control valve is closed almost as fast as one can operate the valve. The device should be ready for propelling another ball as soon as another ball can be loaded into the machine by a forward movement of the barrel. Since the inner end of the barrel moves juxtaposed the inner end of the reducer, the inner end of the barrel also moves inwardly beyond the opened end 59 of the tee so that the tee opening is closed and the air will only travel along the inside of the barrel forcing the ball out of the barrel.

Through trial and error, the correct pressure for propelling a ball a certain distance can be determined. It has been determined that the air pressure control valve can be adjusted for projecting a ball from as low as 10 mph to up to about 150 mph. Since the barrel is metal and the structure from and including the air pressure tank is made of metal, the structure will endure high pressures. The only parts not metal are the reducer and housing and these are not subjected to the high pressure.

The direction for propelling the balls may be determined by the position of the barrel to the supporting structure. Of course the whole device is not overly heavy so the machine could be turned in any direction. However, for moving the outer end of the barrel upwardly or downwardly, the adjusting lever 27 may be rotated to loosen the bolts holding the machine in place and the air pressure tank can be moved backward or forward to change the horizontal angle of the barrel. Also the machine could be rotated to the left or right and then the adjusting levers are tightened once the proper angle and direction has been established.

The machine remains the same from the supports up through the coupling 58 for each different sized ball to be propelled. The diameter of the barrel and housing are chosen for each different sized ball and the housing is secured to the 2½ inch coupling by use of a reducer of the proper size. For propelling a baseball, a, 3 inch PVC tee 7½ inches in length and 3 inch PVC inside diameter pipe is used. Inside the PVC pipe is a barrel having an inside diameter of 2 ⅛ inches and 20 inches long. The outside diameter of the barrel is approximately 3 inches so that there is a close fit within the 3 inch PVC pipe. For a soft ball 3½" inside diameter metal pipe is used for the barrel and a 4" PVC tee and 4" PVC barrel is used. For different sized balls, the barrel, PVC tee and PVC tube must be modified in accordance with the diameter of the ball.

The dimensions used throughout the specification are exemplary and could be changed to different size of diameter and length, if desired.

For continuous operation, a stand pipe or other pipe of a ball-feed device may be connected with the inlet to the tee in order to have a multi-supply of balls available. Since one ball would be adjacent one other ball and the barrel is moved to permit only one ball to enter the chamber of the tee chamber. Thus, the balls in a stand pipe would be fed into the tee chamber one-at-a-time.

The ball propelling machine as shown has to be connected to an air supply of any type such as an air compressor. Since the air pressure tank is small and very little air is used in propelling the ball, a relatively small air compressor would suffice.

The supporting frame structure as shown is made with 2"×2"×3/16", supporting feet with 1¼"×1¼" ×3/16" of angle iron connecting pieces which are brazed together. The length of the angle iron depends on that required to fit the pieces together.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A ball projecting machine for propelling a ball at a desired set speed from a barrel, which comprises a frame supporting a barrel whereby balls are propelled therethrough an air pressure tank, an air pressure control valve, ball admitting means for admitting a ball into an area juxtaposed said air pressure control valve and said barrel from which said ball is propelled, a housing secured at one end to said means for admitting a ball into the area from which the ball is propelled, means connected to and between said outer end of said barrel and means adjacent said ball admitting means for longitudinally moving said barrel, and said barrel is slidable within said housing to open said means for admitting said ball and to close said ball admitting means so that said ball is propelled through said barrel, said barrel having sufficient length to extend with an inner end adjacent said air pressure control valve from which the ball is propelled and an outer end which extends beyond an open end of said housing.

2. A machine as set forth in claim 1, which includes means for rotatably adjusting said barrel in different directions for changing the direction of which balls are propelled.

3. A machine as set forth in claim 2, which comprises a coupling pipe means (58) between said barrel and said control valve.

4. A machine as set forth in claim 2, in which said ball admitting means for admitting said ball into said ball propelling area is a tee fitting having a first end and a second end, said tee fitting is connected at said first end toward said control valve, said housing is connected by a first end to said second end of said tee fitting, and said tee fitting has an opening between said first and second ends which forms said ball admitting means for admitting balls into the propelling area, and said barrel is of sufficient length to close said opening in said tee fitting and to extend beyond an open second end of said housing.

5. A machine as set forth in claim 4, which includes an air pressure gauge and an air pressure regulator secured to a pressure line between said air pressure tank and said control valve and means connecting an air pressure producing means to said air pressure regulator.

6. A machine as set forth in claim 1, which comprises a coupling pipe means (58) between said inner end of said barrel and said control valve.

7. A machine as set forth in claim 6, in which said ball admitting means for admitting said ball into said ball propelling area is a tee fitting having a first end and a second end, said tee fitting is connected at said first end toward said control valve, said housing is connected by a first end to said second end of said tee fitting, and said tee fitting has an opening between said first and second ends which forms said ball admitting means for admitting balls into the propelling area, and said barrel is of sufficient length to close said opening in said tee fitting and to extend beyond an open second end of said housing.

8. A machine as set forth in claim 7, which includes an air pressure gauge and an air pressure regulator secured to a pressure line between said air pressure tank and said control valve, and means connecting an air pressure producing means to said air pressure regulator.

9. A machine as set forth in claim 1, in which said ball admitting means for admitting said ball into said ball propelling area is a tee fitting having a first end and a second end, said tee fitting is connected at said first end toward said control valve, said housing is connected by a first end to said second end of said tee fitting, and said tee fitting has an opening between said first and second ends which forms said ball admitting means for admitting balls into the propelling area, and said barrel is of sufficient length to close said opening in said tee fitting and to extend beyond an open second end of said housing.

10. A machine as set forth in claim 9, which includes an air pressure gauge and an air pressure regulator secured to a pressure line between said air pressure tank and said control valve, and means connecting an air pressure producing means to said air pressure regulator.

11. A machine as set forth in claim 1, wherein a plurality of housings and barrels are provided for interchangeable connection to said ball admitting means each housing and barrel having a different internal dimension to allow projecting balls of different predetermined sizes.

12. The machine as set forth in claim 1 wherein, means adjacent said ball admitting means is a pivotally attached, manually operated lever.

* * * * *